US005086596A

United States Patent [19]

Schlyper et al.

[11] Patent Number: 5,086,596

[45] Date of Patent: Feb. 11, 1992

[54] WEEP AND SEALING WINDOW SYSTEM

[75] Inventors: Omer T. Schlyper; Daniel E. Stokes, both of Bend, Oreg.

[73] Assignee: Bend Millwork Systems, Inc., Bend, Oreg.

[21] Appl. No.: 553,595

[22] Filed: Jul. 18, 1990

[51] Int. Cl.[5] ..... E06B 1/34

[52] U.S. Cl. ..... 52/204; 52/209; 52/304

[58] Field of Search ..... 52/204, 302, 304, 202, 52/203; 49/408, 501

[56] References Cited

U.S. PATENT DOCUMENTS 3,903,650 9/1975 Anderson ..... 52/209 X 4,819,405 4/1989 Jackson ..... 52/304 X

FOREIGN PATENT DOCUMENTS 594284 2/1978 U.S.S.R. ..... 52/209

*Primary Examiner*—David A. Scherbel

*Assistant Examiner*—Joanne C. Downs

*Attorney, Agent, or Firm*—Fitzpatrick, Cella, Harper & Scinto

[57] ABSTRACT

A divided light window has a frame defining a plurality of light openings each of which receive an insulated glass unit. The frame has vertical and horizontal weep grooves cut therein to allow moisture to drain from the window, and a sealing system allows substantial shifting of the glass unit and does not interfere with the weep grooves. The insulated window unit is provided with a tape dam about its perimeter that is disposed opposite the weep grooves to prevent glazing material comprising the sealing system from entering and obstructing the weep grooves.

15 Claims, 3 Drawing Sheets

WEEP AND SEALING WINDOW SYSTEM

BACKGROUND OF THE INVENTION

1. Field of the Invention

This invention relates in general to a window system, and more particularly to a divided light window with a weep and sealing system designed to drain excess moisture from the window.

2. Description of the Prior Art

Divided light windows are well-known in the art. Conventional divided light windows generally include top and bottom rails connected at opposite ends to vertically extending stiles to form an outer frame. One or more horizontal and vertical center bars are used to divide the outer frame into a plurality of light openings. A glass unit, which can consist of a single pane of glass or, for insulated windows, a plurality of glass panes separated from each other by a spacer, is placed within each light opening. The glass unit is secured within each light opening by a bead made of, for example, wood and extending along the outer edges of the glass unit. Typically, the glass unit is placed within the light opening and rests, sometimes with the assistance of glazing tape or glazing compound, against a lip of the frame extending around the periphery of the light opening. The wood bead is then stapled or nailed to the frame of the light opening to hold the glass unit in place.

A common problem with divided light windows, as well as most windows, is the accumulation of moisture within the window. Water that accumulates within the window can cause a wooden frame to warp, check and even rot. Accordingly, there are known several types of window systems that provide for ways to drain water from the window.

For example, U.S. Pat. No. 4,553,361 relates to a door or window frame that includes an interior drain channel to collect and discharge moisture which may leak into the frame. A draining channel is provided in a vertical jamb strip, and a horizontal seal strip includes tiered drainways to collect the water from the draining channel and dispose of it through weep holes. U.S. Pat. No. 4,154,033 relates to a two-part glazing system for a double hung window. Each window is supported by a sash frame having two vertically extending stiles and a top and lower rail. The glazing system is primarily used for the lower rail of the sash frame and includes a liner member and a glazing bead that are snap fit together. The liner member has a flat surface which covers a lip of the lower rail and a front wall that includes drain holes. Water running down the window is designed to run off a front panel of the glazing bead. However, if water works its way between the window and the glazing bead, it is collected in the liner member and drains through the drain holes.

U.S. Pat. No. 3,903,650 relates to a wood gliding window assembly. A lower frame member has convex-shaped glides that slide within a cutout portion of a sill. An elongated notch is provided in the sill and forms a run-off for moisture within the window through a pair of spaced drain ports.

Lastly, U.S. Pat. No. 3,866,369 relates to a reversible sill structure that includes a draining system that may have true divided lights. A glass panel is supported by a pair of spaced-apart tubular members which are joined by an inclined web. The inclined web forms a conduit for directing water through a series of weep holes in one of the tubular members and to the exterior of the sill structure.

SUMMARY OF THE INVENTION

The invention provides an improvement over conventional window draining systems by combining an efficient weep system to drain excess water from the window with an effective sealing system to seal the window.

Accordingly, it is an object of this invention to provide a window, such as a true divided light window, with a weep system for draining excess water from within the window and a sealing system which complements the weep system and provides a flexible window seal.

It is another object of this invention to provide a true divided light window system that enables weeping of accumulated moisture that might collect about any individual light opening.

It is another object of this invention to provide a glazing bead as the primary seal so that glass units can expand or contract within each light opening without breaking the seal.

In accordance with one aspect of the invention, a divided light weep and sealing system comprises a window frame unit including a top rail and a bottom rail connected at their end portions by a pair of vertically extending stiles to form an outer frame. At least one set of horizontal mull bars and a vertical center bar are affixed to an interior surface of the outer frame to define a plurality of light openings. The top rail has a horizontal groove extending the length of an interior surface, and the pair of stiles and the vertical center bar have vertical grooves extending the length of their interior surfaces and opening at a bottom portion of the window frame unit. An insulated window unit has at least an interior window pane and an exterior window pane separated at their perimeters by a continuous spacer, and corner protectors are adhered to each corner of the window unit to provide a perfect right angle at each corner. A strip of sealing tape is wrapped around a perimeter surface of the spacer and is disposed substantially opposite to the grooves in the window frame unit when the window unit is in place. An interior bead of glazing material is applied around each light opening at an interior window pane side of the grooves in the window frame unit, and an exterior bead of glazing material is applied around each light opening at an exterior window pane side of the grooves in the window frame unit to hold the insulated window unit in place.

Other features and advantages of the invention will be set forth in the following description made in connection with the accompanying drawings in which like reference characters refer to similar parts throughout the several views.

BRIEF DESCRIPTION OF THE DRAWINGS

FIG. 3 is a top view of a horizontal center bar of the divided light window in accordance with this preferred embodiment.

DESCRIPTION OF THE PREFERRED EMBODIMENTS

Figure 1:
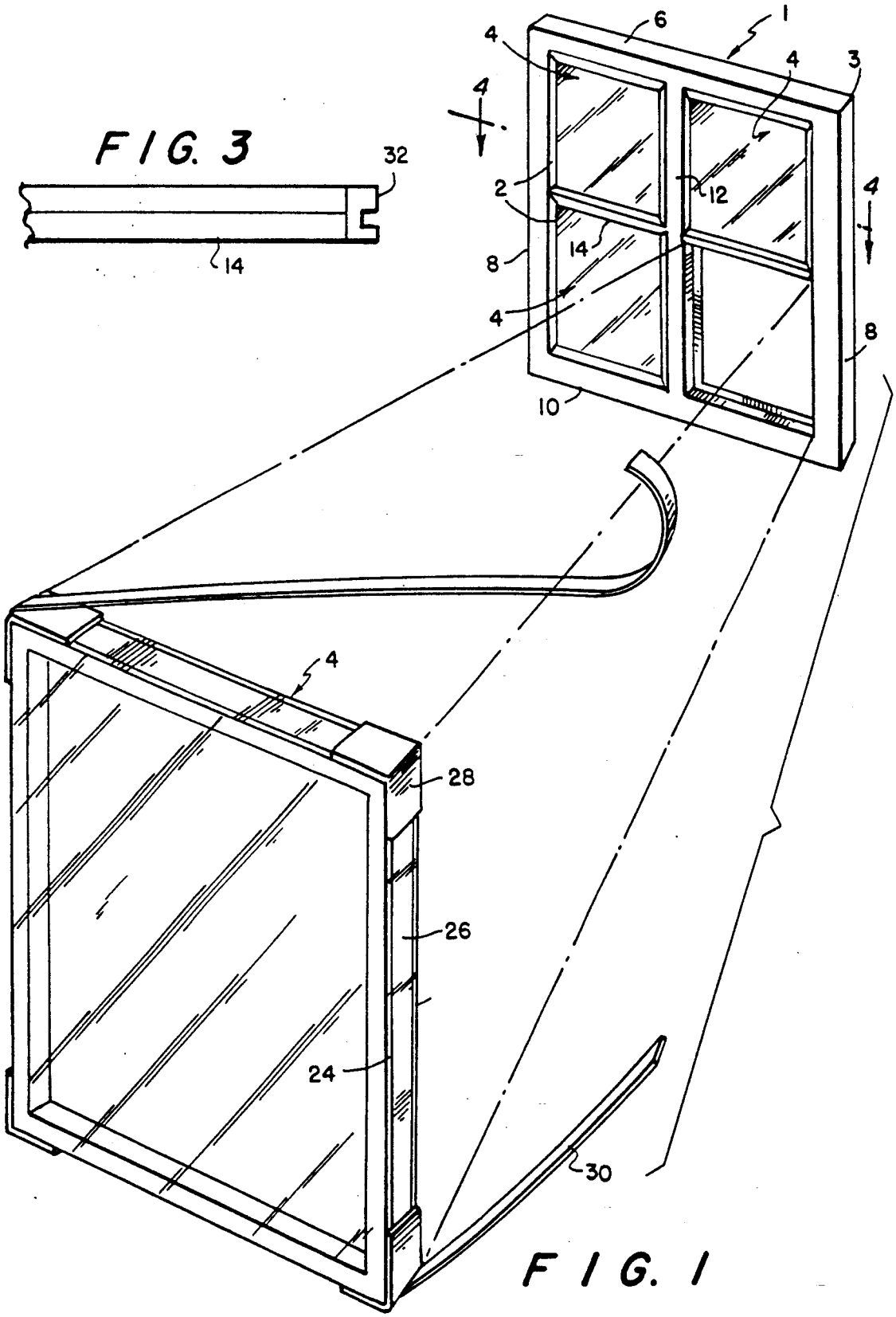
FIG. 1 is a partially exploded perspective view of a divided light window in accordance with the preferred embodiment of the present invention.

A divided light window of the type comprising the invention is indicated generally by the reference numeral 1 and is illustrated in FIG. 1. A window frame 3 defines a plurality of light openings 2, each of which receive an individual window unit 4. Four light openings are depicted in FIG. 1. However, that number is arbitrary, as the invention works equally well with any number of light openings.

The window frame 3 is constructed of a plurality of frame members made of conventional building materials such as wood. With reference to FIG. 1, the frame members include a top rail 6 affixed on each end to a vertically extending stile 8. A bottom rail 10 connects the opposite ends of the stiles 8 to complete an outer frame of the window. The individual light openings 2 are formed by connecting a vertical center bar 12 between the top and bottom rails and mull bars 14 between the center bar and each stile. As shown in FIG. 1, the center rail and mull bars are disposed normal to each other to form substantially square-shaped light openings 2. However, the light openings can be designed to be any desired shape.

FIG. 1 further illustrates in detail a window unit 4 to be placed in each light opening 2. The window unit comprises inner and outer window panes, 22 and 24, respectively, of material such as glass, separated by a continuous spacer 26. The spacer is sealed along the outer edges of the window panes to provide an insulated glass unit. The insulated glass unit could comprise more than two window panes, if desired, each separated by a continuous spacer, without departing from the scope of the invention. Corner protectors 28, made of vinyl, for example, are adhered to the corners of the window unit to form a perfect right angle at each corner. A strip of closed-cell tape 30 is wrapped around the perimeter of the window unit and the corner protectors. The tape is preferably about 3/32 inch thick and ¼ inch wide and is wrapped around the window unit at about one glass pane thickness from the outer pane 24. Of course, the dimensions of the tape and its location on the window unit can vary in accordance with the design specifications of the frame members, which will be discussed in more detail below. The window unit is downsized from the light opening by, for example, an ⅛ inch on each side to provide for movement due to expansion and contraction within the light opening.

Figure 2:
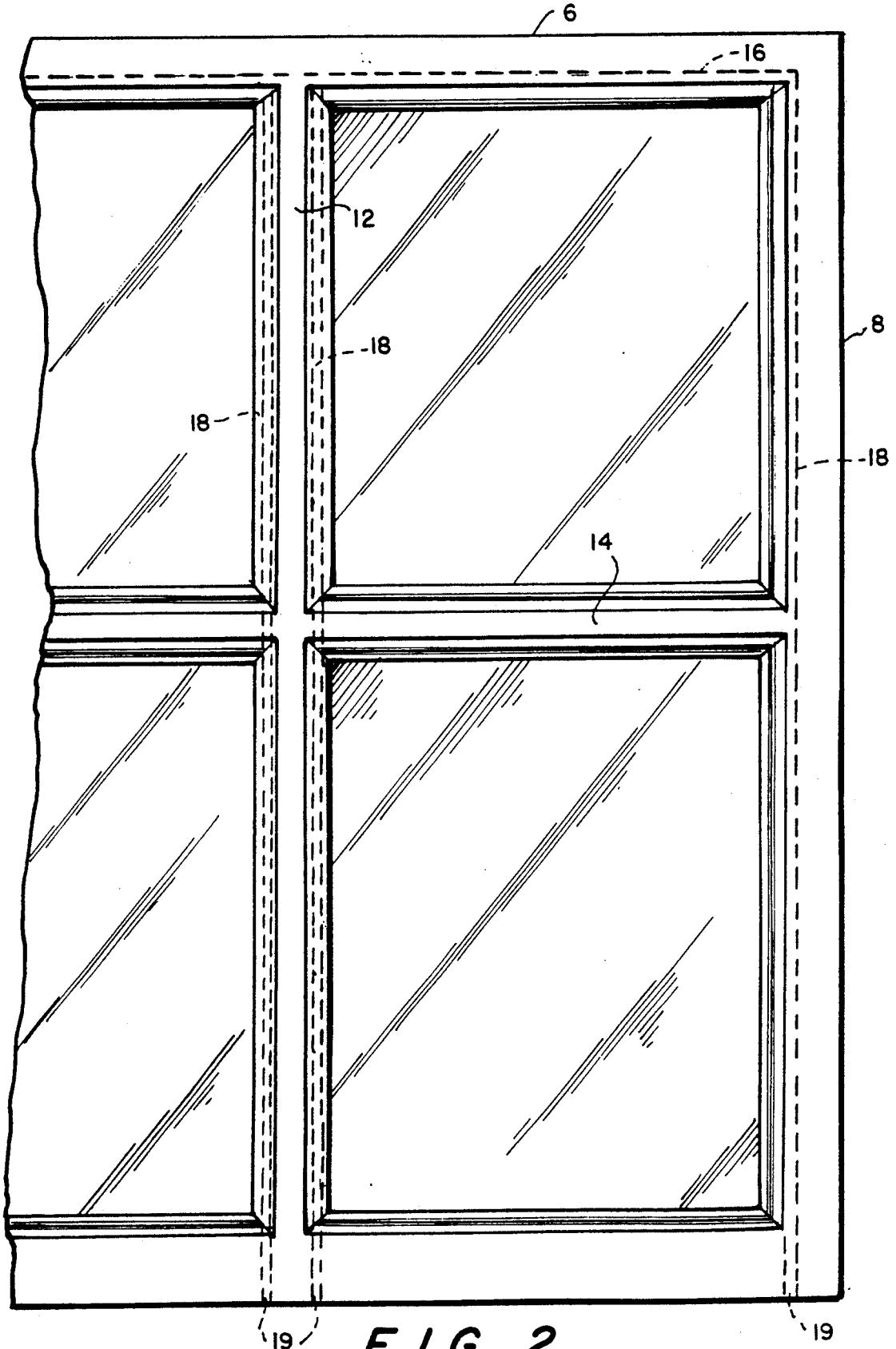
FIG. 2 is a partial front view of the divided light window in accordance with this preferred embodiment.
Figure 4:
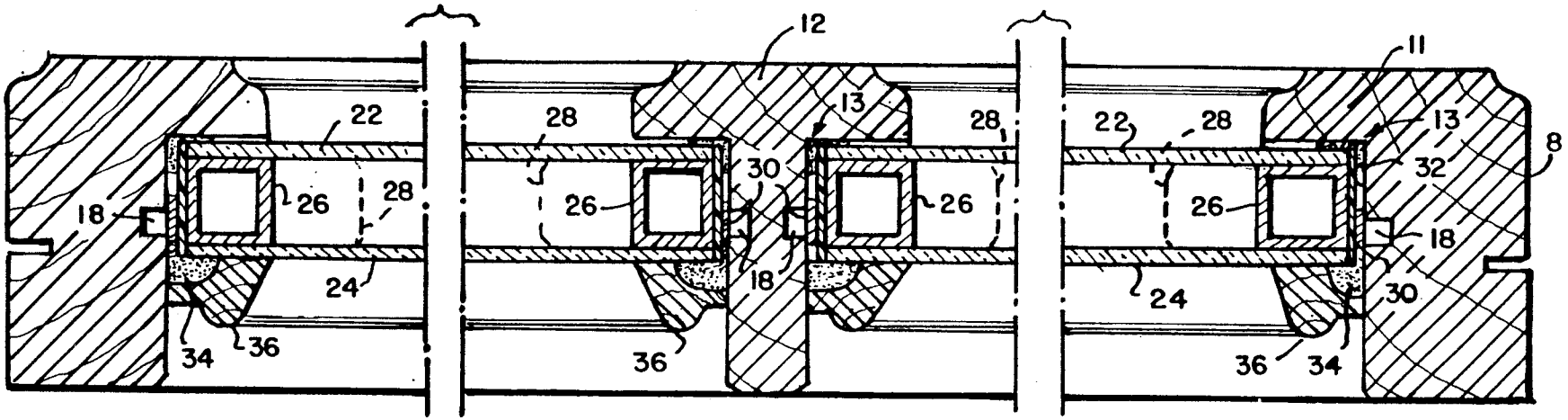
FIG. 4 is a cross-sectional view taken along plane 4—4 in FIG. 1.

FIG. 2 depicts part of the outer frame and shows portions of top rail 6 and stile 8, as well as the center bar 12 and horizontal mull bar 14. The illustrated top rail has a horizontal 3/16 inch by 3/16 inch weep groove shown in dashed lines by reference number 16 milled along its interior surface facing the window unit. The weep groove extends almost the entire length of the top rail 6. Likewise, the stile 8 has a vertical weep groove 18 of the same or similar dimensions as the horizontal weep groove milled along their interior surfaces while the center bar 12 has two such vertical grooves as shown. Thus, each vertically extending frame member, that is, the stiles 8 and the center bar 12, has a weep groove milled along each surface facing a window unit. FIG. 4, which is further discussed below, shows a cross-sectional view of the vertical weep grooves 18 in the stiles 8 and the center bar 12. As seen in FIG. 2, the vertical weep grooves 18 open directly out through the bottom of the window frame at openings 19. The horizontal weep groove 16 connects at both ends to the vertical weep grooves 18 in the stiles 8 and also connects with the vertical weep grooves 18 in the center bar 12. With this construction, water in the horizontal weep groove 16 can drain off through any of the vertical weep grooves 18.

To permit a continuous vertical weep groove, the mull bars 14, as shown in FIG. 3, are provided with tabs 32 that have tab grooves cut therein. The tabs fit within slots in the center bar and stile, and the tab grooves allow a clear passageway through the vertical weep grooves 18. The weep grooves thus allow moisture which accumulates in the window unit to escape out through the bottom of the window. This configuration prevents water from building up within each window unit 4. The effects of standing water that otherwise would not be drained include warping and checking of the frame and also premature rotting, all of which shorten the life of the window.

Figure 5:
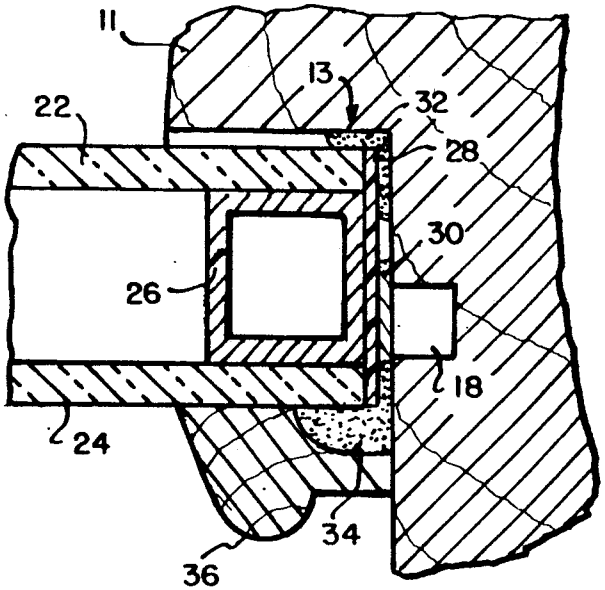
FIG. 5 is an enlarged partial view of FIG. 4.

The manner in which the insulated window unit is disposed within the light opening will now be discussed with reference to FIGS. 4 and 5. FIG. 4 is a cross-section showing the weep and sealing system across the entire width of the divided light window. FIG. 5, on the other hand, is an enlarged view showing one section of the weep and sealing system. As these figures illustrate, the stile 8 has an L-shaped cross-section with a lip portion 11 providing support and backing for the inner pane 22 of the window unit. Each center bar 12 includes similarly shaped lip portions. Initially, an inner bead of glazing compound 32 is applied around an interior corner 13 of the frame defining the light opening.

The window unit 4 bearing the corner protectors 28 and tape 30 is placed within the light opening 2, inner pane 22 first so that it sets within and against the inner bead of glazing compound 32. Next, an outer bead of glazing compound 34 is applied around the light opening, filling the space between the outer pane 24 and the inner surface of the stiles 8 and the center bar 12. The outer bead 34 serves as the primary seal for the window. Moreover, the tape 30 wrapped around the periphery of the glass unit 4 acts as a bridge or a dam to prevent the outer bead 34 from entering and blocking the weep grooves 16 and 18.

The inner bead 32 and outer bead 34 of glazing compound are preferably applied around the entire periphery of the light openings. However, the glazing compound could be applied only at selected portions along the periphery of the light openings if desired.

After the outer glazing bead 34 is applied, a wood bead 36 is disposed around the outer portions of the window unit 4 and stapled to the light opening frame members. The wood bead is used to cover the outer glazing bead 34 and enhance the appearance of the window system.

As best seen in FIG. 5, when the window unit 4 is properly aligned within the light opening, the tape 30 is disposed substantially opposite to the weep groove 18 again so as to block both the inner and outer glazing compound from entering into the weep groove. Although the precise measurements of the tape and the weep grooves can vary, it will be appreciated that the width of the tape should be such that it can bridge the weep groove so as to prevent glazing compound from entering therein.

As noted above, there is a ⅛ inch gap between the window units 4 and the light openings. This gap permits greater than normal amounts of glazing compound, especially in the outer bead, to be used. The glazing compound never sets completely and thus allows the window unit and window frame relatively large freedom to expand and contract without breaking the primary seal.

While the preferred form of the invention has been illustrated and described above, it should be understood that the invention can be modified without departing from the spirit and scope of the invention. Thus, the scope of the invention should be defined by the applied claims. For example, the particular type of window which the disclosed weep and sealing system could be used with is not limited to a divided light window.

What is claimed is:

1. A divided light weep and sealing system, comprising:

a window frame unit including a top rail and a bottom rail connected at their end portions by a pair of vertically extending stiles to form an outer frame, and at least one set of horizontal mull bars and a vertical center bar affixed to an interior surface of said outer frame to define a plurality of light openings, an interior surface of said top rail being formed substantially along its entire length with a horizontal groove, respective interior surfaces of said pair of stiles and said vertical center bar being formed substantially along their entire lengths with respective vertical grooves, said vertical grooves opening at a bottom potion of said window frame unit;

a plurality of insulated window units, one for each of said light openings, each window unit having at least an interior window pane and an exterior window pane separated at their perimeters by a continuous spacer;

a strip of tape wrapped around a perimeter surface of each said spaced and being disposed substantially opposite to the grooves in said window frame unit;

an interior bead of glazing material disposed around each said light opening at an interior window pane side of the grooves in said window frame unit; and an exterior bead of glazing material disposed around each said light opening at an exterior window pane side of the grooves in said window frame unit.

2. A divided light weep and sealing system as set forth in claim 1, further comprising a plurality of corner protectors disposed one on each corner on each said insulated window unit so that said strip of tape forms a right angle at each corner of each said insulated window unit.

3. A divided light weep and sealing system as set forth in claim 1, further comprising a wood bead affixed around at least the inner margin of each light opening to cover said exterior bead of glazing material.

4. A light weep and sealing system as set forth in claim 1, wherein said horizontal mull bars have notched tabs on each end.

5. A divided light weep and sealing system as set forth in claim 1, wherein said insulated window unit has two window panes.

6. A divided light weep and sealing system as set forth in claim 5, wherein said window panes are made of glass.

7. A divided light weep and sealing system as set forth in claim 1, wherein the grooves in said window frame unit are about 3/16 inch wide and about 3/16 inch deep.

8. A divided light weep and sealing system as set forth in claim 7, wherein said tape is about 3/32 inch thick and about ¼ inch wide.

9. A light weep and sealing system, comprising:

window frame means for defining at least one light opening, said window frame means including a continuous, groove in a top surface of said window frame means and extending vertically along side surfaces of each light opening so as to lead outside of said window frame means;

insulated window means for providing a light window in each light opening, each window means comprising at least two window panes disposed face to face and divided at their perimeters by a continuous spacer and having a strip of tape adhered to a perimeter surface of said spacer; and resilient sealing means for sealing said insulated window means in each said light opening and for permitting expansion and contraction of said insulated window means within said window frame unit, said strip of tape being located substantially opposite the continuous groove in said window frame means.

10. A light weep and sealing system as set forth in claim 9, wherein said window panes are made of glass.

11. A light weep and sealing system as set forth in claim 9, wherein the continuous groove in said window frame means is about 3/16 inch wide and about 3/16 inch deep.

12. A light weep and sealing system as set forth in claim 9, wherein said resilient sealing means includes an interior bead of glazing material disposed around each light opening and an exterior bead of glazing material disposed around each light opening, with said interior bead and exterior bead disposed on opposite sides of the continuous groove.

13. A light weep and sealing system as set forth in claim 12, further comprising a wood bead affixed to said window frame unit at each light opening to cover said exterior bead of glazing material.

14. A light weep and sealing system as set forth in claim 9, further comprising corner protecting means adhering to each corner of said insulated window means so that said strip of tape forms a right angle at each said corner.

15. A light weep and sealing system as set forth in claim 14, wherein said tape is about 3/32 inch thick and about ¼ inch wide.

* * * * *

UNITED STATES PATENT AND TRADEMARK OFFICE

CERTIFICATE OF CORRECTION

PATENT NO. : 5,086,596

DATED : February 11, 1992

INVENTOR(S) : OMER T. SCHLYPER, ET AL.

It is certified that error appears in the above-identified patent and that said Letters Patent is hereby corrected as shown below:

COLUMN 5

Line 38, "spaced" should read --spacer--.
Line 57, "light weep and sealing system" should read --divided light weep and sealing system--.

COLUMN 6

Line 17, "continuous," should read --continuous--.

Signed and Sealed this

Twenty-third Day of November, 1993

*Attest:*

Bruce Lehman

BRUCE LEHMAN

*Attesting Officer*

*Commissioner of Patents and Trademarks*

--